US005938094A

United States Patent [19]

Forhan et al.

[11] Patent Number: 5,938,094

[45] Date of Patent: Aug. 17, 1999

[54] COLLAPSIBLE RECEPTACLE/DISPENSER FOR TRASH BAGS

[76] Inventors: Dennis P. Forhan, 1025 Hayfield, Rochester Hills, Mich. 48306; Richard S. Taylor, 309 Connecticut Ave., Marysville, Mich. 48040

[21] Appl. No.: 08/991,229

[22] Filed: Dec. 16, 1997

Related U.S. Application Data

[60] Provisional application No. 60/033,086, Dec. 16, 1996.

[51] Int. Cl.[6] ..... B60R 7/00

[52] U.S. Cl. ..... 224/560; 220/495.01; 224/563; 224/565; 224/566; 229/117.01

[58] Field of Search ..... 224/560, 925, 224/484, 486, 545, 558, 561, 563, 564, 565, 566, 571, 572; 220/495.07, 495.01, 495.05, 495.06, 495.11; 206/554, 390; 229/117.01

[56] References Cited

U.S. PATENT DOCUMENTS

| | | | |
|---|---|---|---|
| D. 180,199 | 4/1957 | Perreault | 224/2 |
| 3,550,833 | 12/1970 | Rahenkamp | 229/117.01 |
| 4,657,176 | 4/1987 | Matsubara | 229/117.01 |
| 4,863,052 | 9/1989 | Lambert | 229/117.3 |
| 5,105,972 | 4/1992 | Waterson et al. | 220/495.11 |
| 5,282,598 | 2/1994 | Greene | 224/556 |
| 5,353,950 | 10/1994 | Taylor et al. . | |
| 5,363,980 | 11/1994 | Mulcahy | 220/495.07 |

*Primary Examiner*—Alian N. Shoap
*Assistant Examiner*—Maerena W. Brevard

[57] ABSTRACT

A collapsible container for storing and dispensing a series of plastic trash bags. The dispenser may be mounted in an automotive vehicle in a convenient location for the users.

In its operative condition, the dispenser container has an upright tubular configuration wherein an upper end panel has an opening for suspending a trash bag within the tubular container. Two opposed side panels of the tubular container can be folded inwardly between two major panels of the container so that the container can be collapsed into a compact flattened condition.

5 Claims, 4 Drawing Sheets

COLLAPSIBLE RECEPTACLE/DISPENSER FOR TRASH BAGS

CROSS-REFERENCE TO A RELATED PATENT APPLICATION

This patent application is a continuation-in-part of my co-pending provisional patent application Ser. No. 60/033,086 filed Dec. 16, 1996.

BACKGROUND AND SUMMARY OF THE INVENTION

Dispensers for holding consumable articles such as tissue paper, trash bags and the like, are known in the art. However, as far as we are aware, no such dispensers are available that can be mounted in a suitable location in a modern vehicle and then collapsed when the contents of the dispenser have been completely dispensed.

The broad purpose of the present invention is to provide an easily manufactured dispenser for consumable articles such as a string of trash bags. The preferred embodiment of the invention can be mounted in suitable locations in a vehicle such as on the floor, connected to the floor mat, or clipped to a seat pocket. The trash is inserted in one of the bags in the dispenser. When the bag is full it is removed with its contents. When the dispenser is empty, it can be readily collapsed and stored in a compact location.

The preferred embodiment of the invention is made from a one-piece blank of suitable material. The blank is cut with a rectangular central body panel, a pair of side panels that extend in one direction, and a pair of end panels that extend at right angles to the side panels. The side panels are scored with several parallel score lines so that they can be folded with a rectangular central body panel, to form a four-sided enclosure having a pair of end openings.

The two end panels are similar in configuration and may be folded-up to close the end openings. Each of the end panels has either a ridge or a flap that frictionally engages the other two panels to close the end openings. One end panel has an opening for receiving trash into a bag. The other panel has a three-sided clip that can be bent for engaging a floor mat.

When the dispenser has been emptied, the two end panels are folded 270° to a position adjacent the bottom of the central body, and the other panels are collapsed adjacent the central body.

Still further advantages of the invention will become readily apparent to those skilled in the art to which the invention pertains upon reference to the following detailed description.

DESCRIPTION OF THE DRAWINGS

The description refers to the accompanying drawings in which like reference characters refer to like parts throughout the several views, and in which.

DESCRIPTION OF THE PREFERRED EMBODIMENT

Figure 4:
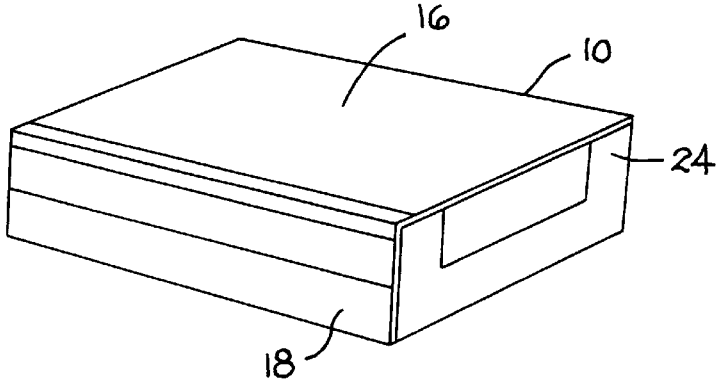
FIG. 4 is a view of the assembled dispenser.
Figure 5:
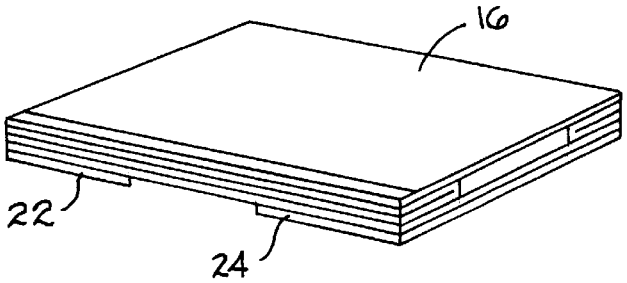
FIG. 5 is a view of the dispenser in its collapsed position.

Referring to the drawings, FIG. 4 illustrates a dispenser 10 illustrating the preferred embodiment of the invention. Dispenser 10 is formed from a unitary sheet or blank 12 illustrated in FIG. 1, and is folded to form a generally rectangular bottom or central panel 14, a side panel 16, a side panel 18 and a side panel 20. The sheet also has a pair of end panels 22 and 24.

Sheet 12 is preferably made from a one-piece sheet of a suitable material about ⅛" thick.

Figure 1:
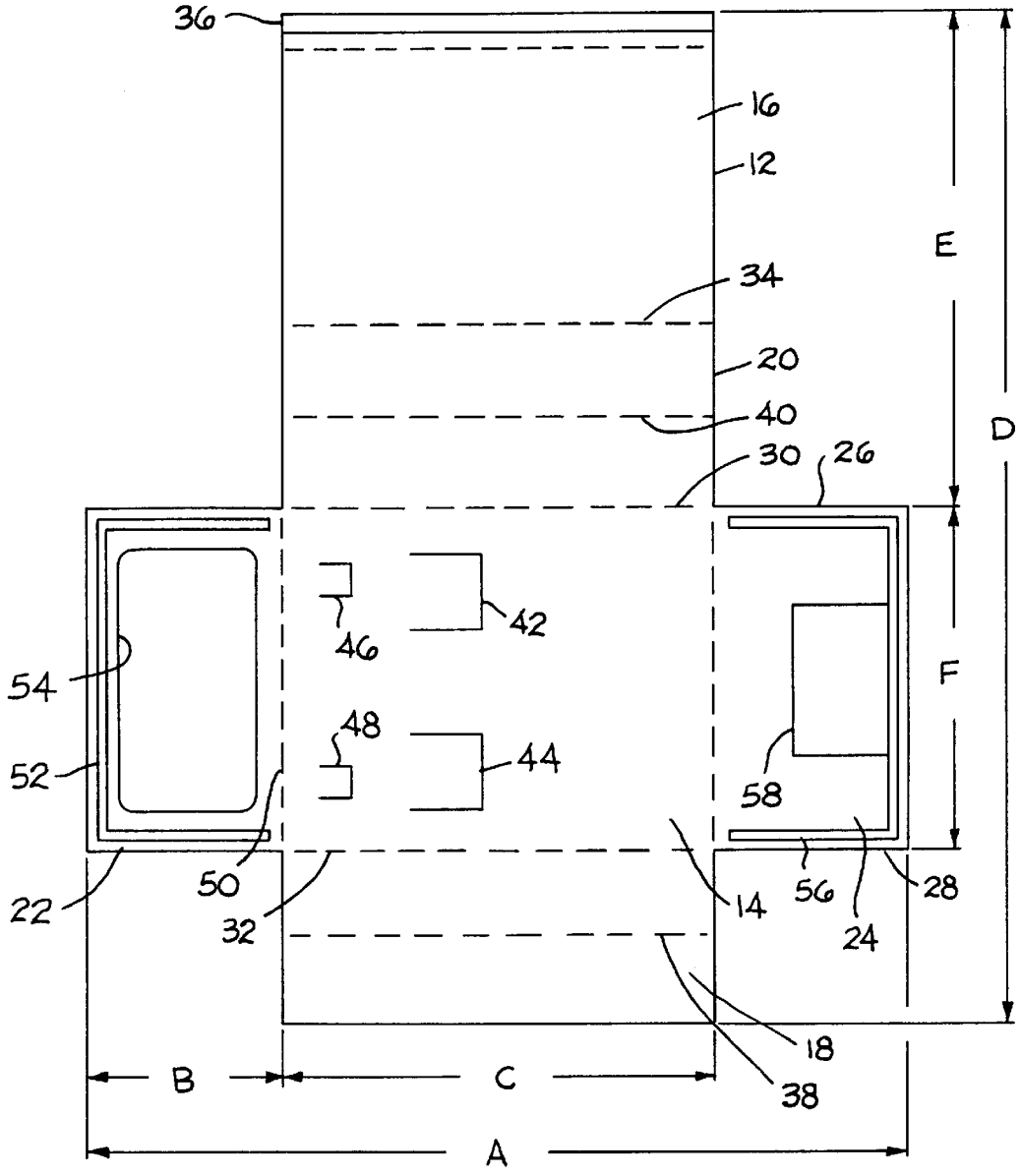
FIG. 1 illustrates an unfolded sheet blank that can be folded to form a dispenser illustrating the preferred embodiment of the invention.
Figure 2:
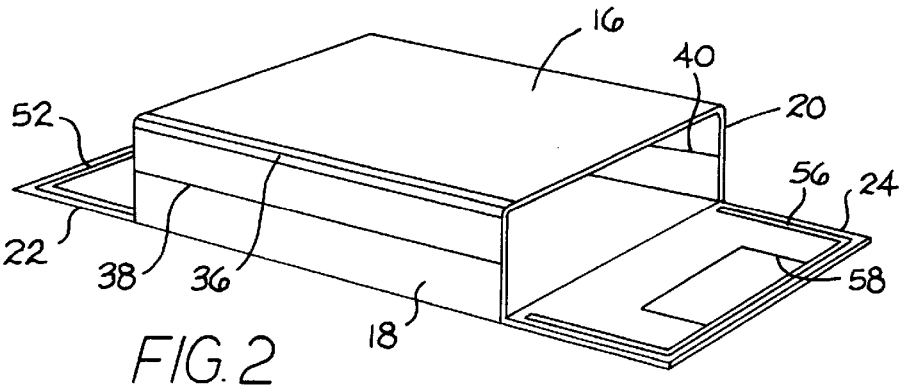
FIG. 2 shows the blank of FIG. 1 folded to form an enclosure with the two end panels in their unfolded position.
Figure 3:
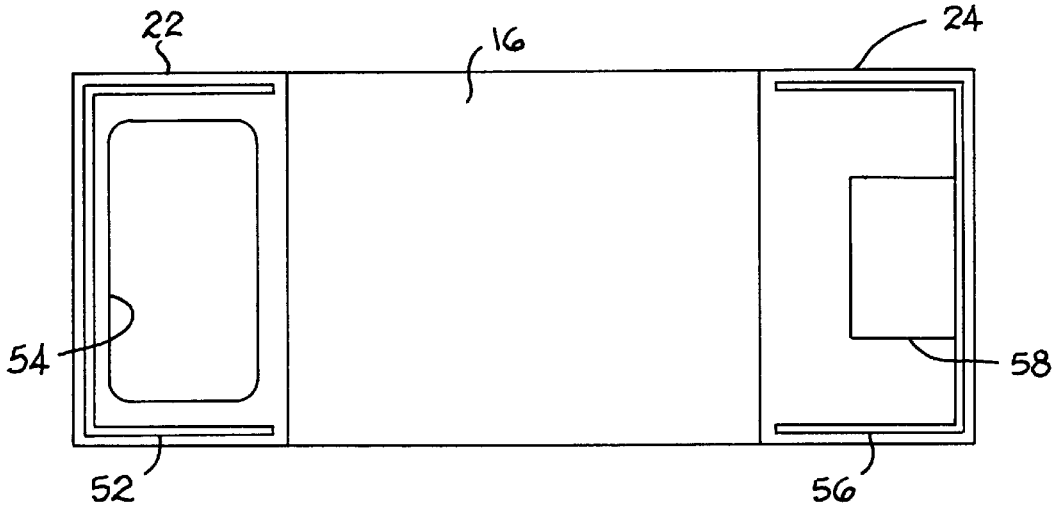
FIG. 3 is a plan view of the FIG. 2 structure.

Referring to FIG. 1, for illustrative purposes, the sheet has an over-all width A of 17¾" and is cut to form end panel 22 which has a height B of 4¼". Central panel 14 has a length C of 9¼", and end panel 24 has a height of about 4¼". The side edges of the two end panels are formed along a pair of imaginary parallel lines 26 and 28, and connected along a pair of integral hinge lines 30 and 32 so that panels 16 and 18 can be bent upwardly to a position at right angles to central panel 14, as illustrated in FIG. 2. The length D of the dispenser blank is 22½". The width of end panels 22 and 24, as shown at "F" is 7¼". The combined length E of panels 16 and 20 is 11⅛".

Panel 16 is connected to panel 20 along a fold or hinge line 34, that is parallel to hinge line 30 and spaced about 3¾" from hinge line 30. Hinge line 34 permits panel 16 to be folded to a position parallel to central panel 14 with the outer edge of panel 16 adjacent the outer edge of panel 18, as shown at 36 in FIG. 2. Thus, hinge lines 30, 32 and 34 permit panels 16, 18 and 20 to be folded to form a four-sided enclosure.

Figure 6:
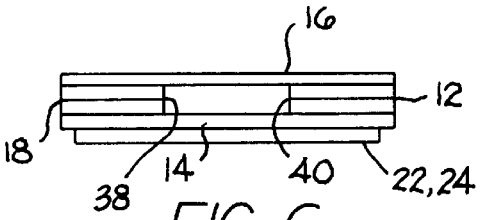
FIG. 6 is an end view of the collapsed dispenser.

Side panel 18 has a height of 3¾" and a second hinge line or living hinge at 38, which is half way between hinge line 32 and the outer edge of panel 18, and parallel to hinge line 32. Hinge line 38 permits panel 18 to be folded in half, as illustrated in FIG. 6. Similarly, side panel 20 has a hinge line 40 forming a living hinge that is parallel to hinge line 30 and which permits side panel 20 to be folded inwardly, as illustrated in FIG. 6. Thus, the two fold lines or hinges 38 and 40 permit the dispenser, when adhered to or adjoined together to be collapsed with top panel 16 closely adjacent to bottom or central panel 14.

Figure 8:
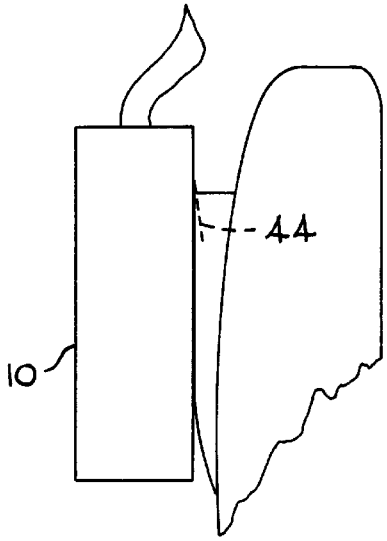
FIG. 8 illustrates the dispenser clipped to a seat pocket.

Bottom panel 14 is perforated to form a pair of larger three-sided clips 42 and 44, and a pair of smaller three-sided clips 46 and 48. The clips may be bent down and away from the bottom panel for engaging the back pocket of a vehicle seat, as illustrated in FIG. 8.

When side panels 18 and 20 and top panel 16 are folded to form the four-sided enclosure illustrated in FIG. 2, end panels 22 and 24 can be folded upwardly to close the openings in the opposite ends of the enclosure. The blank has a hinge line at 50 forming a living hinge that is aligned with the side edges of panels 16 and 18 and which permits end panel 22 to be swung from its closed position, illustrated in FIG. 4, down 270° to a bottom position, illustrated in FIG. 6. In its closed position, panel 22 closes one end of the dispenser housing. In its bottom position, panel 22 is closely adjacent to and parallel to the under side of the bottom panel.

Panel 22 is formed with an integral ridge 52 which extends along the three edges of panel 22 to form a frictional fit with the edges of panels 16, 18 and 20 when closing one opening of the dispenser.

End panel 22 also has a rectangular access opening 54 for inserting trash into a bag in the dispenser.

Figure 9:
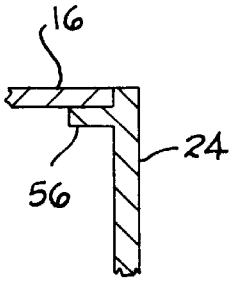
FIG. 9 is an enlarged fragmentary view illustrating the manner in which the ridges on the end panels frictionally engage the enclosure walls.

The other end panel 24 also has an integral three-sided ridge 56 which is closely adjacent to and parallel to the edges of the panel. A typical section of ridge 56 is illustrated in FIG. 9 and is typical of ridge 52 of the other end panel to show how the ridge frictionally engages the inner surfaces of panels 16, 18, and 20 to hold end panels 22 and 24 in their respective closed positions. The cross section and length of the ridge is chosen to provide sufficient frictional engagement to hold the end panels in their closed positions, but also to permit the user to open the end panels to collapse the dispenser.

Figure 7:
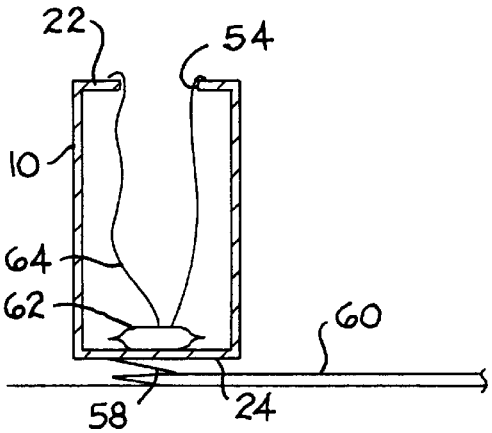
FIG. 7 illustrates the dispenser clipped to a floor mat.

End wall 24 also is perforated to form a three-sided clip 58, which may be bent outwardly as illustrated in FIG. 7 to frictionally engage floor mat 60 of a vehicle in order to hold the dispenser in an up-right position.

As shown in FIG. 2, blank 12 can be formed into a rectangular tube, prior to swinging the end panels 22 and 24 into the final configurations depicted in FIG. 4. An adhesive tape 36 secures the free edge of side panel 16 to the free edge of side panel 18, as shown in FIG. 2. End panels 22 and 24 are swung to their FIG. 4 positions after the blank has been formed into the FIG. 2 tubular condition. Ridges 52 and 56 fit within the ends of the tube to prevent side panels 18 and 20 from collapsing inwardly around hinge lines 38 and 40.

In use, panels 16, 18 and 20 are bent to the positions illustrated in FIG. 2, adhered to or adjoined together and then end panels 22 and 24 folded upwardly to close the end openings of the dispenser. Preferably, end wall 24, prior to being closed, is attached to a dispensing pouch 62 of the type illustrated in our U.S. Pat. No. 5,353,950. A string of trash bags 64 may be removed from pouch 62. A typical bag is opened around opening 54. The trash is inserted in the bag opening. When the bag is full, the end panel is opened, the bag separated from the next bag in the pouch, and the bag and contents removed from the dispenser.

When the dispenser has been fully emptied of bags, it may then be collapsed to the condition of FIG. 6 by folding the side panels inwardly so that top panel 16 is closely adjacent bottom panel 14. In this condition, the dispenser may be stored in a relatively flat compact condition.

Figure 10:
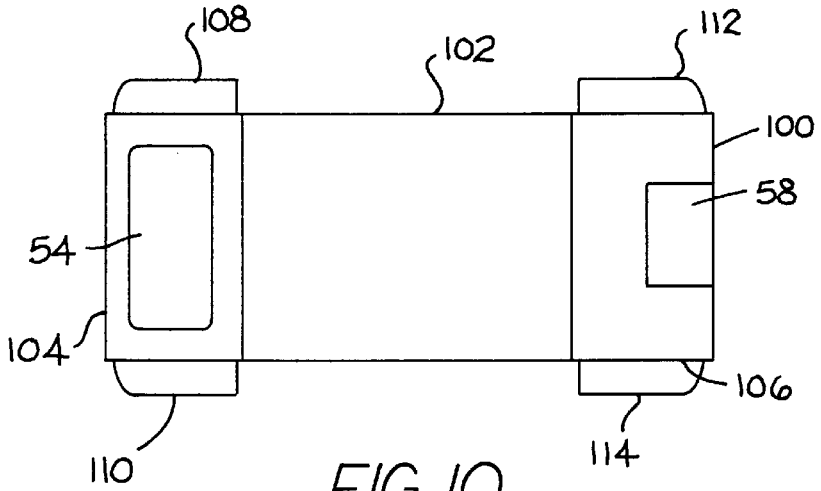
FIG. 10 illustrates an alternative manner with flaps that frictionally hold the end panels closed.

FIG. 10 illustrates another embodiment of the invention in the form of a blank 100 which has the same profile as the embodiment of FIG. 1, and in which the side panels have been folded to form a four-sided enclosure 102. The panel 100 also has a pair of end panels 104 and 106. Panel 104 has a pair of side flaps 108 and 110 instead of the ridge 52. Similarly end panel 106 has a pair of flaps 112 and 114 instead of ridge 56. Flaps 108 and 110 frictionally engage the opening of the enclosure to frictionally hold it in place when the end panels close. Similarly end panel 106 is frictionally held in place by flaps 112 and 114.

Figure 11:
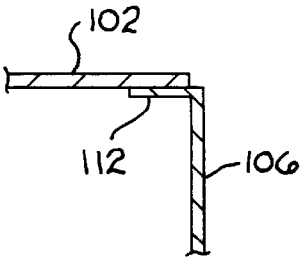
FIG. 11 is an enlarged view showing how the flaps engage the enclosure panels.

FIG. 11 illustrates how end panel 106 is held in its closed position by a typical flap 112 frictionally engaging the internal surface of the central enclosure.

FIGS. 12 through 15 shows a third form of the invention embodiment of FIGS. 1 through 9 except that end panel 22 has an integral flap closure 66 extending from its free edge.

Figure 12:
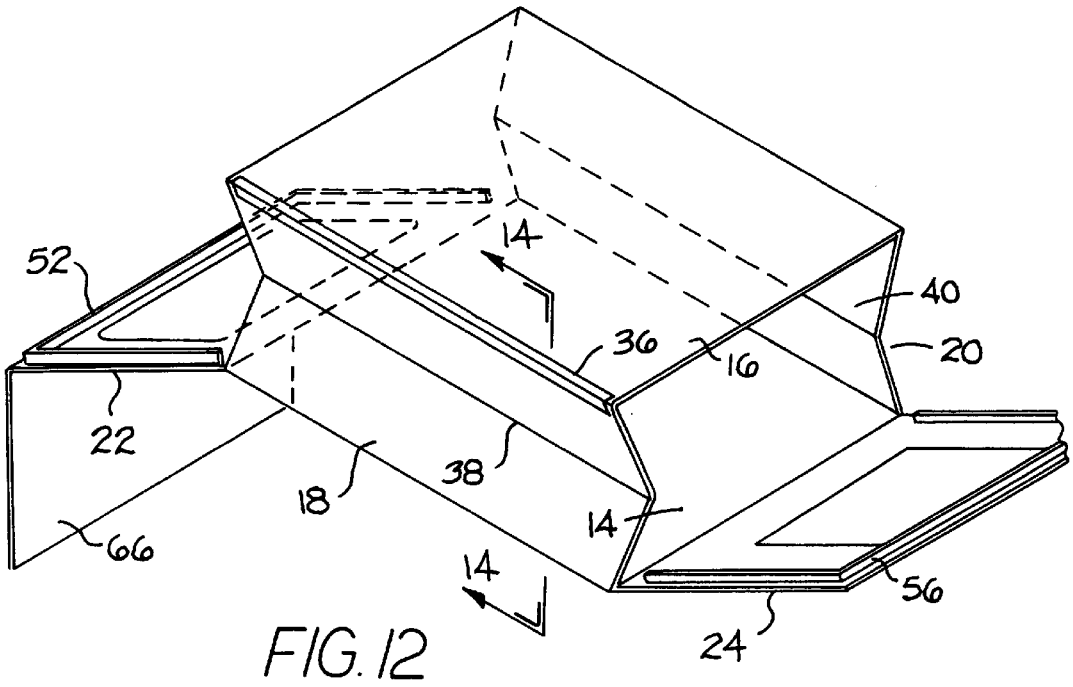
FIG. 12 is a perspective view taken in the same direction as FIG. 2, but showing a further embodiment of the invention.

FIG. 12 shows the dispenser box in a partially formed condition, generally similar to the condition of the FIG. 1 embodiment depicted in FIG. 2. When the ends panels 22 and 24 are swung upwardly to position ridges 52 and 56 within the rectangular tube (formed by panels 14, 16, 18 and 20) the dispenser box will assume a rigid condition, generally similar to the erected condition depicted in FIG. 4.

Figure 13:
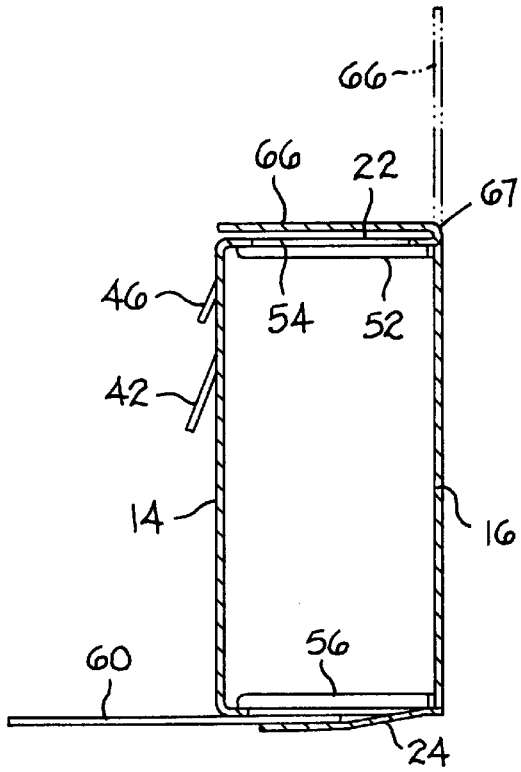
FIG. 13 is a view taken in the same direction as FIG. 7, but showing the FIG. 12 container in a supported position.

As shown in FIG. 13, flap closure 66 has a living hinge connection 67 with end panel 22, whereby the closure can be swung down to a closed position overlying the bag access opening 54, or upwardly to an open position exposing the access opening 54.

Figure 14:
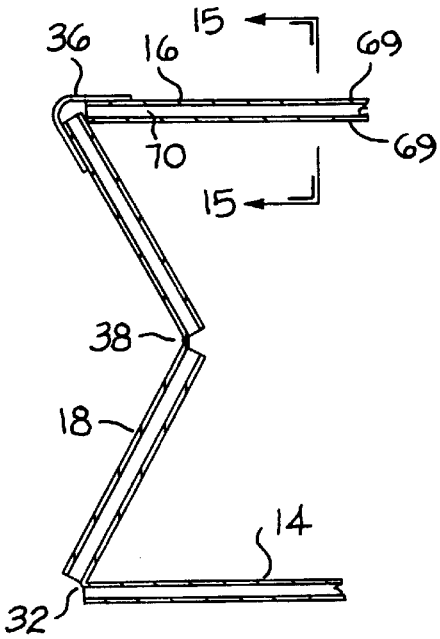
FIG. 14 is an enlarged fragmentary sectional view taken on line 14—14 in FIG. 12.
Figure 15:
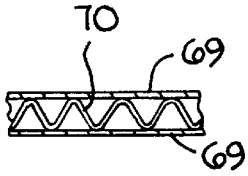
FIG. 15 is a fragmentary sectional view taken on line 15—15 in FIG. 14.

The dispenser box can be formed of any suitable rigid sheet material. For cost reasons, it is preferred to form the box of low cost corrugated paperboard material. FIGS. 14 and 15 show some features of a corrugated paperboard material that can be used. As there shown, the sheet material can include two surface sheets 69 and a corrugated liner sheet 70 adhesively secured to each surface sheet.

The various living hinges at the corners of the rectangular tube and within side panels 18 and 20, can be formed by cutting part way through the paperboard material, as shown, e.g. at 32 and 38 in FIG. 14.

In lieu of corrugated paperboard, the dispenser container could be formed of low cost sheet plastic material; in such case the living hinges could be formed by scoring the plastic sheet material part way through the sheet thickness.

We claim:

1. A dispenser container for trash bags comprising:

a rectangular tube that comprises a first major panel (14), a second major panel (16) extending parallel to said first major panel, and two side panels (18,20) connecting said first and second major panels;

each of said side panels comprising two hingedly-connected sections that are foldable into the space between the first and second major panels for collapsing said tube into a flattened condition;

said tube having two open ends;

a first end panel hingedly connected to said first major panel for closing one open end of the tube; and a second end panel hingedly connected to said first major panel for closing the other open end of the tube;

each of said end panels being swingable through an arc of approximately two hundred seventy degrees for disposition against said first major panel when tube is in a flattened condition, whereby the container then has a relatively flat collapsed condition wherein the major dimension of the container is substantially the same as that of said first major panel; and said first end panel having a bag-accommodating opening (54) therein, whereby an open replaceable trash bag can be suspended from said first end panel so as to extend through said opening into the tube; and means for preventing inward folding of said side panels comprising inturned flaps extending from each said end panel for disposition against the inner surfaces of said side panels when said end panels are in a position to close the ends of said rectangular tube.

2. The dispenser container of claim 1, wherein said major panels, side panels and end panels are integrally formed out of a single sheet.

3. The dispenser container of claim 1, and further comprising means for supporting said rectangular tube in an upright position within an automotive vehicle.

4. A dispenser container for trash bags comprising:

a rectangular tube that comprises a first major panel (14), a second major panel (16) extending parallel to said first major panel, and two side panels (18, 20) connecting said first and second major panels;

each of said side panels comprising two hingedly-connected sections that are foldable into the space between said first and second major panels for collapsing said tube into a flattened condition;

said tube having two open ends;

a first end panel hingedly connected to said first major panel for closing one open end of the tube; and a second end panel hingedly connected to said first major panel for closing the other open end of the tube;

each of said end panels being swingable through an arc of approximately two hundred seventy degrees for disposition against said first major panel when said tube is in a flattened condition, whereby the container then has a relatively flat collapsed condition wherein the major dimension of the container is substantially the same as that of said first panel;

each said end panel having plural edges adapted to extend across an end surface of the rectangular tube, and ridges extending along selected ones of said edges for disposition against inner surfaces of said side panels to prevent inward folding of said side panels; and said first end panel having a bag-accommodating opening (54) therein, whereby an open trash bag can be suspended from said first end panel so as to extend through said opening into the tube.

5. A dispenser container for trash bags comprising:

a rectangular tube that comprises a first major panel (14), a second major panel (16) extending parallel to said first major panel, and two side panels (18, 20) connecting said first and second major panels;

each of said side panels comprising two hingedly-connected sections that are foldable into the space between said first and second major panels for collapsing said tube into a flattened condition;

said tube having two open ends;

a first end panel hingedly connected to said first major panel for closing one open end of the tube; and a second end panel hingedly connected to said first major panel for closing the other open end of the tube;

each of said end panels being swingable through an arc of approximately two hundred seventy degrees for disposition against said first major panel when said tube is in a flattened condition, whereby the container then has a relatively flat collapsed condition wherein the major dimension of the container is substantially the same as that of said first panel;

said first end panel having a bag-accommodating opening (54) therein, whereby an open trash bag can be suspended from said first end panel so as to extend through said opening into the tube; and means for supporting said rectangular tube in an upright position within an automotive vehicle; said supporting means comprising a clip (58) struck outwardly from said second end panel for engagement with a floor mat in an automotive vehicle.

* * * * *